US008199062B2

(12) United States Patent
Johnson et al.

(10) Patent No.: US 8,199,062 B2
(45) Date of Patent: Jun. 12, 2012

(54) PHASED-ARRAY ANTENNA RADIATOR PARASITIC ELEMENT FOR A SUPER ECONOMICAL BROADCAST SYSTEM

(75) Inventors: Torbjorn Johnson, Vaxbolm (SE); John Schadler, Raymond, ME (US); Gary Lytle, Portland, ME (US)

(73) Assignees: SPX Corporation, Charlotte, NC (US); Radio Innovation Sweden AB, Kista (SE)

( * ) Notice: Subject to any disclaimer, the term of this patent is extended or adjusted under 35 U.S.C. 154(b) by 358 days.

(21) Appl. No.: 12/427,669

(22) Filed: Apr. 21, 2009

(65) Prior Publication Data

US 2009/0267856 A1 Oct. 29, 2009

Related U.S. Application Data

(60) Provisional application No. 61/046,750, filed on Apr. 21, 2008.

(51) Int. Cl.
*H01Q 21/26* (2006.01)

(52) U.S. Cl. ..... 343/797; 343/833

(58) Field of Classification Search ..... 343/797, 343/833, 834

See application file for complete search history.

(56) References Cited

U.S. PATENT DOCUMENTS

| | | | | |
|---|---|---|---|---|
| 3,277,490 | A * | 10/1966 | Williams | 343/792.5 |
| 3,936,835 | A * | 2/1976 | Phelan | 343/753 |
| 4,268,833 | A * | 5/1981 | Milne | 343/833 |
| 4,668,956 | A * | 5/1987 | Mahnad | 343/789 |
| 4,825,222 | A | 4/1989 | Butcher | |
| 5,245,349 | A * | 9/1993 | Harada | 343/700 MS |
| 5,451,968 | A | 9/1995 | Emery | |
| 6,429,816 | B1 | 8/2002 | Whybrew et al. | |
| 7,952,531 | B2 * | 5/2011 | Liu | 343/742 |
| 2007/0254587 | A1 | 11/2007 | Schadler et al. | |

OTHER PUBLICATIONS

Simon Cornelis Joseph Worm, "Corrugated Elliptical Horn Antennas for the Generation of Radiation Patterns With Elliptical Cross-Section", Technische Hogeschaol Eindhoven, May 14, 1985.

* cited by examiner

*Primary Examiner* — Michael C Wimer
(74) *Attorney, Agent, or Firm* — Baker & Hostetler LLP

(57) ABSTRACT

A parasitic element for a phased-array antenna radiator is provided. The radiator comprises a first dipole radiator including two coplanar monopole radiating elements disposed symmetrically about a radiation axis, a second dipole radiator, arranged orthogonally with respect to the first dipole radiator, including two coplanar radiating elements disposed symmetrically about the radiation axis, and a parasitic gain element, having a substantially elliptical shape, disposed above the first and second dipole radiators and centered on the radiation axis.

19 Claims, 6 Drawing Sheets

PHASED-ARRAY ANTENNA RADIATOR PARASITIC ELEMENT FOR A SUPER ECONOMICAL BROADCAST SYSTEM

CROSS-REFERENCE TO RELATED APPLICATIONS

This application claims priority to U.S. Provisional Patent Application Ser. No. 61/046,750 (filed on Apr. 21, 2008, entitled "Phased-Array Antenna Radiator Parasitic Element for a Super Economical Broadcast System"), the contents of which are incorporated herein by reference in their entirety.

FIELD OF THE INVENTION

The present invention relates, generally, to cellular communication systems. More particularly, the present invention relates to parasitic elements for a phased-array antenna radiator.

BACKGROUND OF THE INVENTION

Cellular radiotelephone system base transceiver stations (BTSs), at least for some United States (U.S.) and European Union (EU) applications, may be constrained to a maximum allowable effective isotropically radiated power (EIRP) of 1640 watts. EIRP, as a measure of system performance, is a function at least of transmitter power and antenna gain. As a consequence of restrictions on cellular BTS EIRP, U.S., EU, and other cellular system designers employ large numbers of BTSs in order to provide adequate quality of service to their customers. Further limitations on cells include the number of customers to be served within a cell, which can make cell size a function of population density.

One known antenna installation has an antenna gain of 17.5 dBi, a feeder line loss of 3 dB (1.25" line, 200 ft mast) and a BTS noise factor of 3.5 dB, such that the Ga−NFsys=17.5−3.5−3.0=11 dBi (in uplink). Downlink transmitter power is typically 50 W. With feeder lines, duplex filter and jumper cables totaling −3.5 dB, the Pa input power to antenna is typically 16 W, such that the EIRP is 16 W+17.5 dB=1,000 W.

In many implementations, each BTS is disposed near the center of a cell, variously referred to in the art by terms such as macrocell, in view of the use of still smaller cells (microcells, nanocells, picocells, etc.) for specialized purposes such as in-building or in-aircraft services. Typical cells, such as those for city population density, have radii of less than 3 miles (5 kilometers). In addition to EIRP constraints, BTS antenna tower height is typically governed by various local or regional zoning restrictions. Consequently, cellular communication providers in many parts of the world implement very similar systems.

Restrictions on cellular BTS EIRP and antenna tower height vary within each country. Not only is the global demand for mobile cellular communications growing at a fast pace, but there are literally billions of people, in technologically-developing countries such as India, China, etc., that currently do not have access to cellular services despite their willingness and ability to pay for good and inexpensive service. In some countries, government subsidies are currently facilitating buildout, but minimization of the cost and time for such subsidized buildout is nonetheless desirable. In these situations, the problem that has yet to be solved by conventional cellular network operators is how to decrease capital costs associated with cellular infrastructure deployment, while at the same time lowering operational expenses, particularly for regions with low income levels and/or low population densities. An innovative solution which significantly reduces the number of conventional BTS site-equivalents, while reducing operating expenses, is needed.

SUMMARY OF THE INVENTION

Embodiments of the present invention provide a parasitic gain element for a phased-array antenna radiator.

In one embodiment, the radiator comprises a first dipole radiator including two coplanar monopole radiating elements disposed symmetrically about a radiation axis, a second dipole radiator, arranged orthogonally with respect to the first dipole radiator, including two coplanar radiating elements disposed symmetrically about the radiation axis, and a parasitic gain element, having a substantially elliptical shape, disposed above the first and second dipole radiators and centered on the radiation axis.

There have thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as in the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Embodiments of the present invention provide a novel parasitic gain element for a phased-array antenna radiator.

According to one aspect of the present invention, cell spacing, i.e., the distance between adjacent BTSs, is advantageously increased relative to conventional cellular systems while providing a consistent quality of service (QoS) within each cell. Preferred embodiments of the present invention increase the range of each BTS. Conventional macrocells typically range from about ¼ mile (400 meters) to a theoretical maximum of 22 miles (35 kilometers) in radius (the limit under the GSM standard); in practice, radii on the order of 3 to 6 mi (5-10 km) are employed except in high-density urban areas and very open rural areas. The present invention provides full functionality at the GSM limit of 22 mi, for typical embodiments of the invention, and extends well beyond this in some embodiments. Cell size remains limited by user capacity, which can itself be significantly increased over that of conventional macrocells in some embodiments of the present invention.

Commensurate with the increase in cell size, the BTS antenna tower height is increased, retaining required line-of-sight (for the customary 4/3 diameter earth model) propagation paths for the enlarged cell. Preferred embodiments of the present invention increase the height of the BTS antenna tower from about 200 feet (60 meters) anywhere up to about 1,500 ft (about 500 m). In order for the transmit power and receive sensitivity of a conventional cellular transceiver (user's hand-held mobile phone, data terminal, computer adapter, etc.) to remain largely unchanged, both the EIRP and receive sensitivity of the tower-top apparatus for the SEC system are increased at long distances relative to conventional cellular systems and reduced near the mast. These effects are achieved by the phased-array antenna and associated passive components, as well as active electronics included in the present invention.

Standard BTS equipment, such as transceivers, electric power supplies, data transmission systems, temperature control and monitoring systems, etc., may be advantageously used within the SEC system. Generally, from one to three or more cellular operators (service providers) may be supported simultaneously at each BTS, featuring, for example, 36 to 96 transceivers and 216 to 576 Erlang of capacity. Alternatively, more economical BTS transmitters (e.g., 0.1 W transmitter power) may be used by the cellular operators, further reducing cost and energy consumption. These economical BTSs have a smaller footprint and lower energy consumption than previous designs, due in part to performance of transmitted signal amplification and received signal processing at the top of the phased-array antenna tower rather than on the ground.

Figure 1:
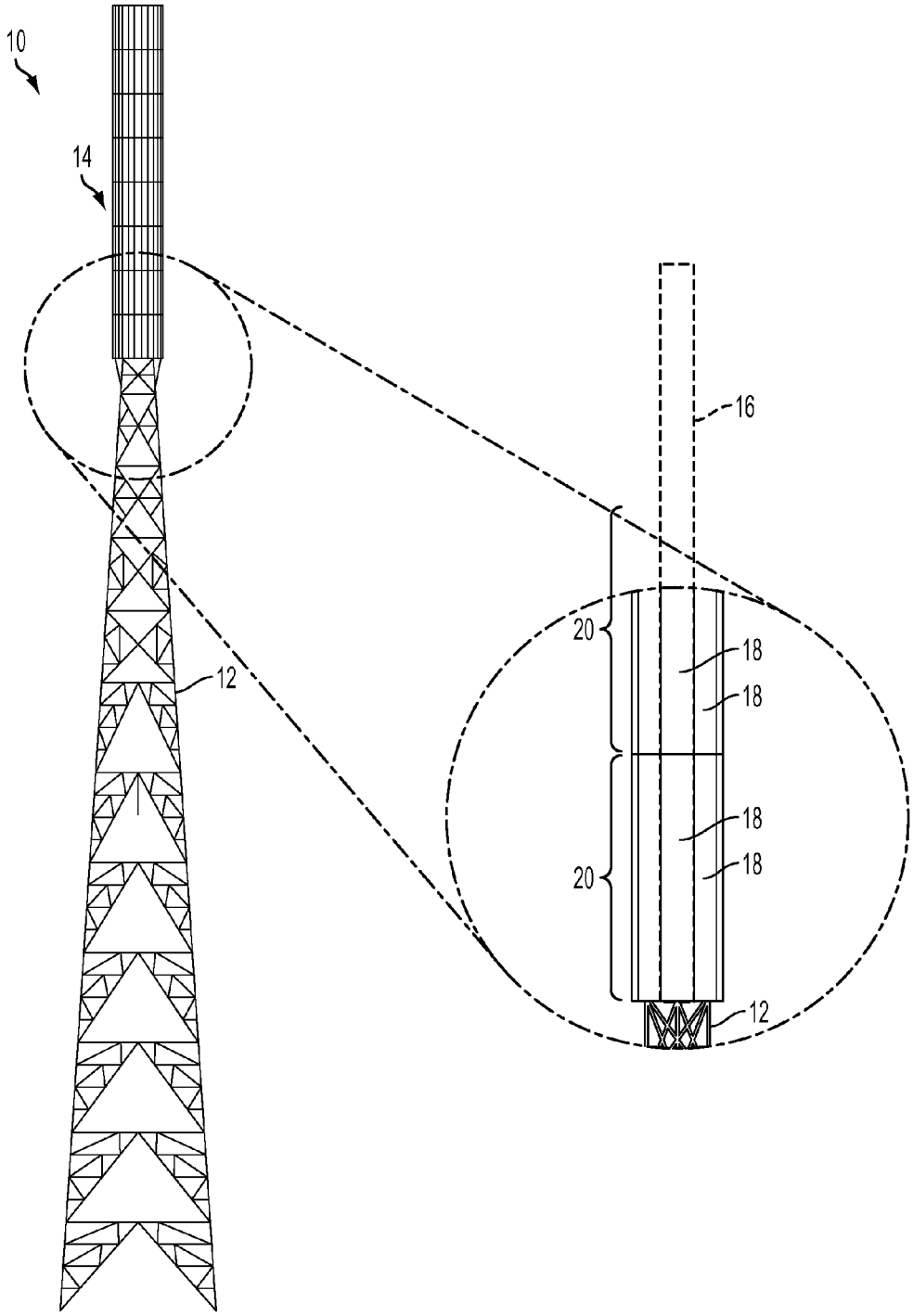
FIG. 1 depicts a perspective view of a base transceiver station antenna, in accordance with an embodiment of the present invention.

FIG. 1 presents a perspective view of a BTS antenna, in accordance with an embodiment of the present invention.

The base transceiver station 10 includes an antenna tower 12 and a phased-array antenna 14, with the latter disposed on an upper portion of the tower 12, shown here as the tower top. The antenna 14 in the embodiment shown is generally cylindrical in shape, which serves to reduce windload, and has a number of sectors 16, such as, for example, 6 sectors, 8 sectors, 12 sectors, 18 sectors, 24 sectors, 30 sectors, 36 sectors, etc., that collectively provide omnidirectional coverage for a cell associated with the BTS. Each sector 16 includes a number of antenna panels 18 in a vertical stack. Each elevation 20 includes a number of antenna panels 18 that can surround a support system to provide 360° coverage at a particular height, with each panel 18 potentially belonging to a different sector 16. Each antenna panel 18 includes a plurality of vertically-arrayed radiators, which are enclosed within radomes that coincide in extent with the panels 18 in the embodiment shown.

Feed lines, such as coaxial cable, fiber optic cable, etc., connect cellular operator equipment to the antenna feed system located behind the respective sectors 16. At the input to the feed system for each sector 16 are diplexers, power transmission amplifiers, low-noise receive amplifiers, etc., to amplify and shape the signals transmitted from, and received by, the phased-array antenna 14. In one embodiment, the feed system includes rigid power dividers to interconnect the antenna panels 18 within each sector 16, and to provide vertical lobe shaping and beam tilt to the panels 18 in that sector. In another embodiment, flexible coaxial cables may be used within the feed system.

Figure 2:
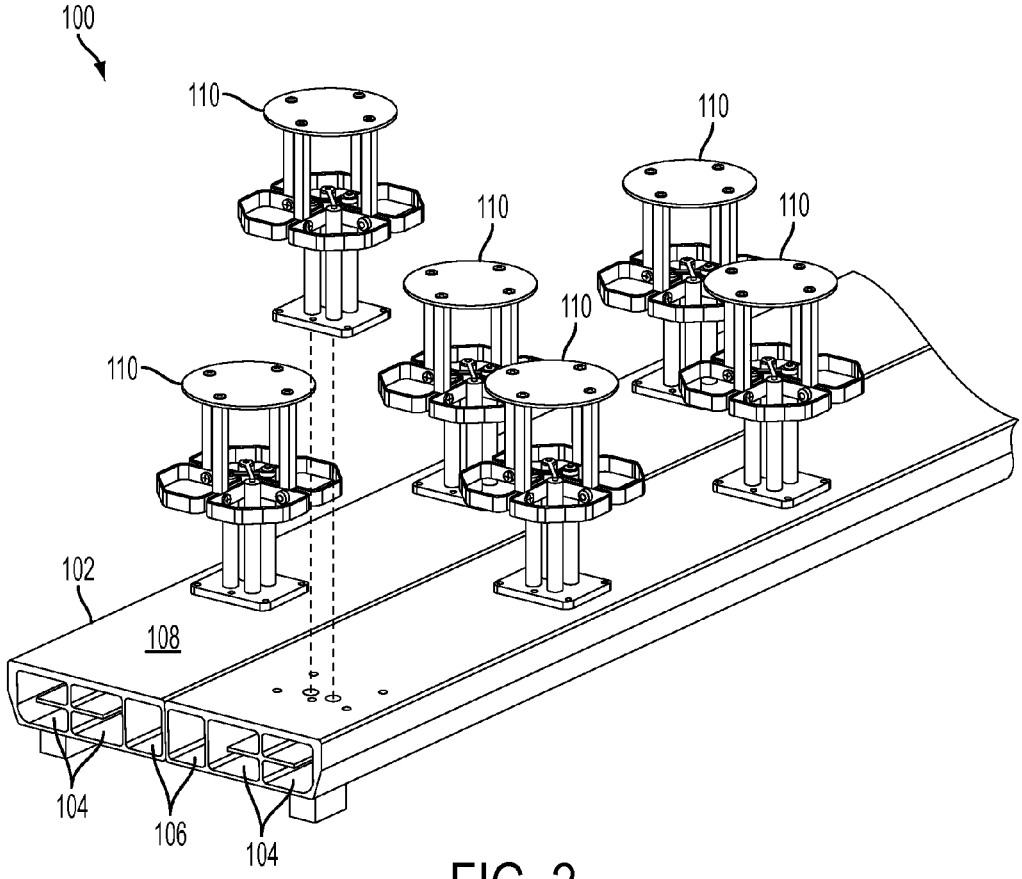
FIG. 2 depicts a perspective view of a partial antenna panel, in accordance with an embodiment of the present invention.

FIG. 2 depicts a perspective view of a partial antenna panel 100, in accordance with an embodiment of the present invention. A single rectangular box extrusion 102 has four internal chambers 104, operative as discrete, grounded signal line outer conductors, in addition to any number of structural chambers 106, functional at least as stiffeners. Outer surfaces of the chambers 106 further serve, along with external surfaces of the signal line chambers 104, to establish a continuous reflector face (backplane) 108 proximal to a plurality of radiators 110.

Figure 3:
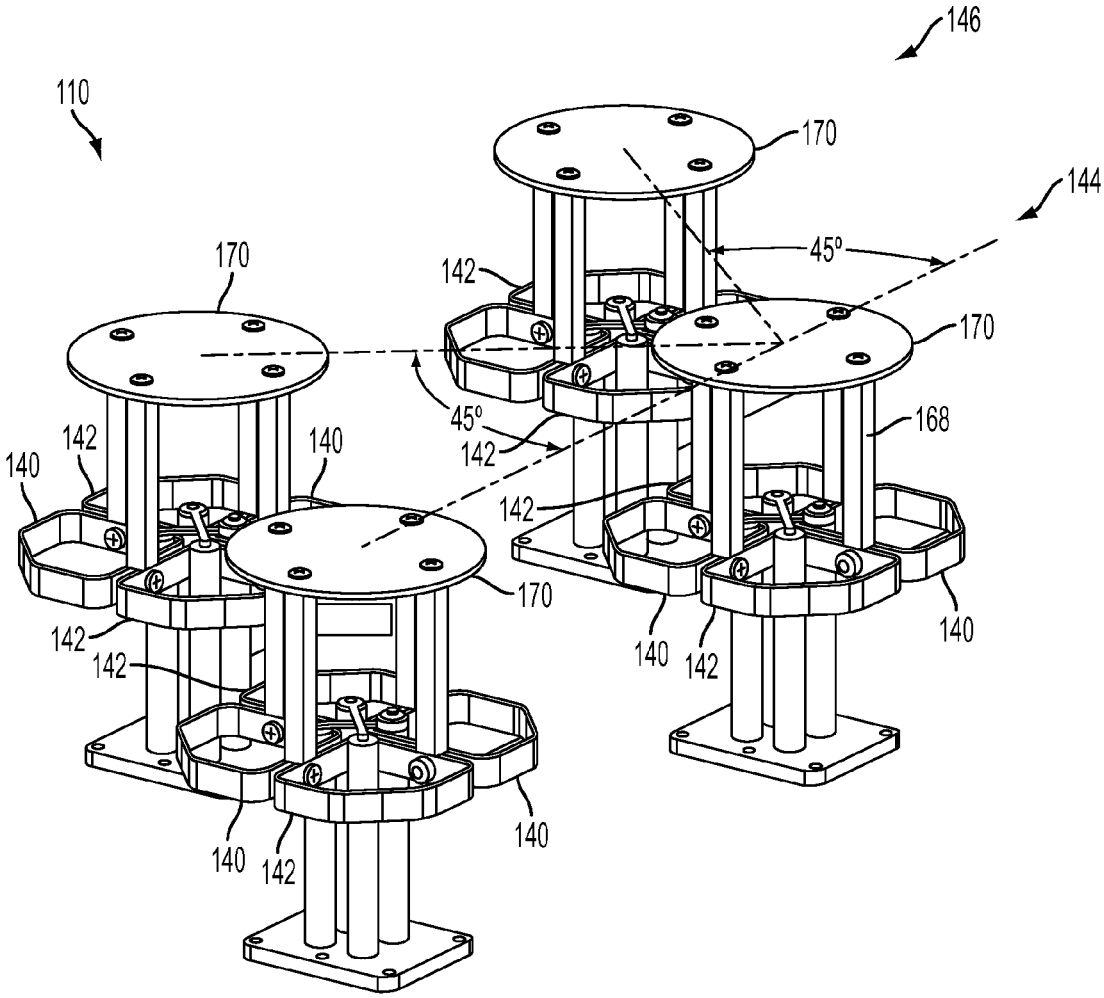
FIG. 3 depicts a group of four crossed-dipole radiators, in accordance with an embodiment of the present invention.

FIG. 3 depicts an arbitrary group of four, proximate crossed-dipole radiators 110, in accordance with an embodiment of the present invention. Radiators 110, including transverse quadrilateral crossed dipoles 140, 142, are mounted on a face 108 of the antenna panel 100 (shown in FIG. 2), and arranged in a staggered configuration. In at least one embodiment, radiators 110 are similar, in some respects, to radiators disclosed within U.S. Patent Application Publication No. 2007-0254587 (published Nov. 1, 2007), which is incorporated herein by reference in its entirety. Radiators 110 advantageously exhibit intrinsic low cross coupling between their respective dipoles 140, 142. When spaced vertically about a wavelength apart, they further exhibit intrinsic low mutual coupling between proximal radiators 110. In one preferred embodiment, radiators 110 transmit and receive signals in the 900 MHz frequency range.

Radiators 110 are arranged in two staggered vertical rows 144, 146 of radiators 110, so that the dipoles 140, 142 in each row are, in some instances, oriented end-to-end with dipoles on proximal radiators 110 in the other row, or oriented orthogonally thereto; these dipoles are substantially non-interacting. The remaining dipoles 140, 142 in alternate rows 144, 146 are parallel, and spaced between 0.5 and 0.7 wavelengths apart. These dipoles are sufficiently close to affect impedance of one another. In compensation, the termination impedance of the feed system may be altered, by a process such as that described below. Vertical spacing between the radiators 110 is substantially equal and uniform within each of the staggered rows 144, 146. Spacing may be selected to provide maximum radiative efficiency, to provide beam shaping, or for other purposes. Horizontal spacing between rows 144, 146 may be selected to maintain isolation between orthogonal dipoles, which can be realized using a 45 degree angle between radiators 110 as shown. Vertical separation between radiators 110 may be greater or less in some embodiments, provided horizontal spacing is adjusted along with vertical spacing to control impedance and coupling characteristics. Excessive separation can produce grating lobes in some embodiments.

The modified quadrilateral, or "cloverleaf," construction of the dipoles 140, 142 and their spacing further provides a voltage standing wave ratio (VSWR) that is low over at least a bandwidth required for cellular telephony, namely about 7.6% for the basic 900 MHz GSM band, or up to 9.1% for the P-, E-, or R-extended versions of that band. For the 1.8 GHz GSM band, bandwidth is again about 9.1%, with the gap between transmit and receive frequencies roughly equal to that of the E-GSM band. The individual monopoles of each dipole have straight portions parallel to straight portions of adjacent monopoles of the other dipole; spacing and length of these parallel portions can be selected to cause them to function as transformers with particular values of coupling. This can control an extent of isolation between the orthogonal dipoles within a radiator.

Design variants can be configured to realize specific azimuth beam widths. For example, 30 degree and 45 degree widths are readily implemented, and the design further supports beam narrowing to 22.5 degrees or less and broadening to 60 degrees or more. Beam width is determined by details of the "clover leaf" shape of the dipoles 140, 142, by the spacing, number, and size of parasitics 170, supported by spacer insulators 168, by implementation of alternate backplane 108 geometries, such as basket, lip, or curved surfaces of different widths, and by other alterations. These variants permit the number of sectors making up an omnidirectional antenna to be at least 12-around or 8-around, for 30 degree and 45 degree radiator beam widths, respectively, with greater and lesser numbers likewise realizable. Selection of azimuth beam width, as well as selection of a total number of sectors serving a cell, such as eight, 12, 16, or 24 sectors, for example, may be determined by requirements such as the number of service providers operating within a cell and sharing the antenna, the number of mobile units to be served, a preferred limit of frequency reuse, and the like.

Figure 4:
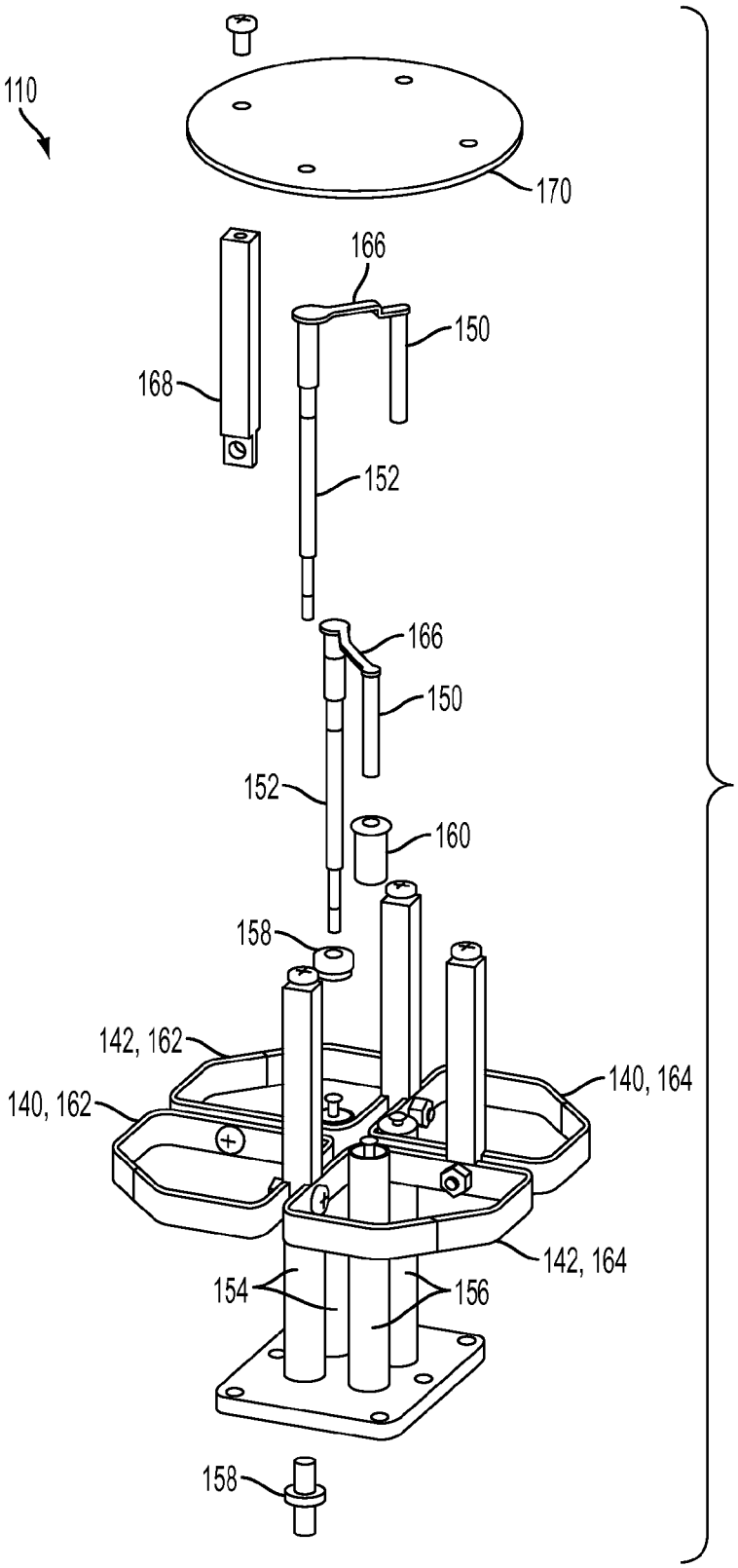
FIG. 4 depicts an exploded view of crossed-dipole radiator, in accordance with an embodiment of the present invention.

FIG. 4 depicts an exploded view of crossed-dipole radiator 110, in accordance with an embodiment of the present invention. Coupling from the suspended stripline terminations within the backplane to the respective dipoles 140, 142 is by outer conductors 154 and inner conductors 152 that cross over in the form of unbalanced feed straps 166 and tuned stubs 150 that jointly form balanced terminations.

Advantageously, embodiments of the present invention include feed lines, such as, for example, rigid coaxial line feeding each dipole 140, 142 within the radiators 110, each of which includes an inner conductor 152 which, after passing out through the end of an outer conductor 154, which also provides structural support, crosses the center of the dipole 140, 142 by a feed strap 166 and couples by a tuned conductive feed stub 150 to another outer conductor 156, which also provides structural support. The respective inner conductors 152 and outer conductors 154 form coaxial feed lines having characteristic impedances based on diameter ratios between the inner 152 and outer 154 conductors and the dielectric constants of any insulators/fill materials 158. The feed stubs 150 likewise have diameter ratios with the outer conductors 156, lengths, and dielectric fillers 160 chosen to establish termination impedances that couple signal energy to the first monopoles 162 over the selected frequency range. The feed straps 166 are unbalanced, and the spacing between the radiators further affects input impedance, so the selected lengths of the feed stubs 150 are factors in termination matching at the level of the entire antenna.

In one preferred embodiment, radiators 110 transmit and receive signals in the 900 MHz range. In this embodiment, the outer conductors 154, 156 are approximately 3.4" long, 0.07" thick and 0.5" in diameter, the inner conductors 152 are approximately 4.4" long and 0.15" in diameter, the feed straps 166 are approximately 1.5" long, and the stubs 150 are approximately 2.4" long and 0.15" in diameter. The monopole radiating elements 162, 164 are generally rectangular in shape, with one truncated corner, are approximately 2.6" long on each side and have a square cross section of approximately 0.2". These dimensions are, of course, not intended to be limiting and may be adjusted by one skilled in the art, in accordance with the teachings of the present invention, to accommodate other applications, frequency ranges, etc.

Advantageously, embodiments of the present invention have appreciably lower transmit signal levels and has receive functionality, each of which increases PIM product susceptibility. As a consequence, both highly smoothed component shape and uniformity of material composition within each component are potentially beneficial, while electromechanical joints are potential sources of PIM products.

For example, prototyping of the antenna embodiments illustrated in the figures can result in PIM products being manifested repeatedly and to some extent unpredictably. Construction of the parts shown from larger numbers of simple screw-machine formed and/or cut and stamped parts, assembled with screws, is associated with PIM production. Disassembly/reassembly activities that eliminate one PIM may introduce another. Slightly-damaged screw slots, variations in assembly torque, traces of oils in connection points, and the like all represent potential sources of PIM-related defects detectable at the receiver, requiring prolonged troubleshooting to overcome.

In a preferred embodiment, subgroups of the parts making up each radiator and each panel may be candidates for consolidated into single parts as shown, and enhanced processes for realizing connection uniformity may be adopted with a view to preventing generation of PIM products. For example, each of the outer conductors 154, 156 may be formed as a single piece with its associated monopole 162, 164, such as by investment casting or a comparable high-precision metal forming process. Indeed, all four may be cast with a common base in some embodiments. Similarly, the inner conductors 152 and stubs 150, along with feed straps 166, may be one piece as shown, whether cast, forged, molded from a powder-metal slurry and fired to final size, or the like. The extruded backplane 108, shown in FIG. 3, is likewise a product of such reduction in PIM vulnerability, since preferred embodiments have unitized construction with a continuous, substantially smooth interior that functions as a stripline reference ground. It is to be observed that any holes drilled through the extruded backplane 108 for radiator connection or stripline mounting require rigorous deburring on blind sides thereof (i.e., removal of burrs formed on interior surfaces of the extruded backplane 108 as a result of drilling inward from an external surface thereof) to suppress still other PIM product sources.

Materials for configurations addressed herein may vary. As previously noted, copper, copper-bearing alloys, and aluminum alloys are generally usable for at least some parts of apparatus incorporating the invention. For casting, forging, and related processes, some zinc-rich alloys exhibit desirable properties, subject to further enhancement by tin, copper, and/or alloy plating, similar to present processes for manufacturing U.S. one-cent pieces (pennies). Zinc's lower conductivity (than copper, aluminum, and some other alloys) may be of little effect in view of the low surface current densities of antennas according to the invention. For other forming processes, other materials may be preferred. Plating of conductive materials over less-conductive cores may be practical, such as electrodeposition of copper over cores molded from carbon fiber reinforced epoxy. Indeed, carbon fiber-reinforced units may be sufficiently conductive for use alone in some embodiments. Climate-driven degradation of metallic structural and bond integrity from electronegativity differences has been shown in previous applications to be a minor aspect of at least some combinations of materials in typical environments, but may require verification. Insulating coatings may be beneficial, with the understanding that effects on transmitting and receiving characteristics from applying thin layers of dielectrics may require compensation.

Joining conductive or conductive-surface parts is required in substantially all embodiments. In the instance of copper-over-tin plated cast zinc feeds joined to copper striplines, conventional soft or hard soldering can provide rapid, high-yield, reworkable joints. Brazing or welding processes may narrow material choices, while conventional practice for such processes introduces positioning challenges and may tend to produce spatter that can be difficult to find and remove in enclosed spaces. Screw assembly, such as in the prototype assembly procedure described above, may require more extensive testing to verify that PIM products are absent.

Figure 5:
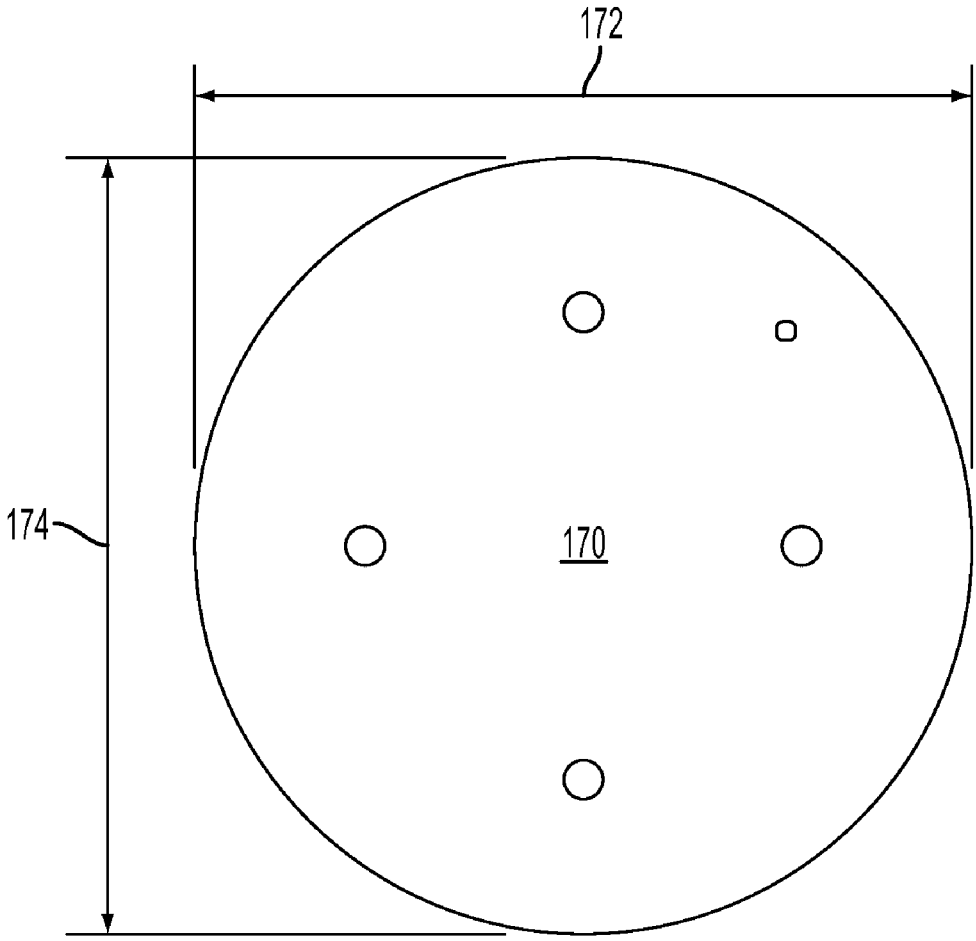
FIG. 5 is a plan view of an elliptical parasitic element, in accordance with an embodiment of the present invention.

FIG. 5 depicts an elliptical parasitic gain element 170 in plan view, in accordance with an embodiment of the present invention. The parasitic 170 is also shown on each of the radiators 110 in FIG. 4. The height 172 and width 174 of the parasitic 170 may be substantially equal, or may differ by a few percent, at least in some embodiments. For example, in an antenna operable over a portion of the 900 MHz band on the order of 9.1% wide, a parasitic 170 having a height of 4.20 inches and a width of 4.41 inches, for an effective ellipticity of less than 4.8% (or, by another definition, an ellipticity of about 0.3), in place of a circular parasitic, advantageously reduces or neutralizes anisotropy for specific applications.

Without parasitic elements, the elevation and azimuth performance of each 45 degree slanted beam is less than ideal. A single, circular parasitic, roughly a half-wavelength in diameter, suitably spaced from the dipoles 140, 142, improves gain. Elevation/azimuth anisotropy is largely unaffected by this circular parasitic. However, changing the shape of the parasitic 170 from circular to elliptical alters the relative gain of the vertical and horizontal components of each of the slanted beams. Advantageously, parasitic 170 ellipticity may be derived analytically to correct expected anisotropy. Similarly, ellipticity may be modified by experiment to identify performance defects and develop a value of parasitic 170 ellipticity sufficient to compensate for measured anisotropy.

In the embodiment shown, a fairly low parasitic 170 ellipticity, on the order of 5% or less, is sufficient to compensate for calculated and observed anisotropy in vertical arrays of 45 degree slanted dipoles, and significantly improves upon performance at least of circular parasitic discs of any comparable diameter at the same or comparable spacing. Note that the "size" of the parasitic 170 can be referred to by its mean diameter, the square root of the product of the major and minor axes. Embodiments of various ellipticities may have the same surface area as a circular parasitic, and thus the same "size," although the anisotropy correction differs with ellipticity.

Each antenna embodiment may be subject to anisotropy as a function of radiator-level and system-level design variations, as well as differences between transmitted and received signal anisotropy due at least to frequency differences between the transmitter channels and the receive channels. Similarly, terrain may affect isotropy to a sufficient extent to justify variations in parasitic-element ellipticity from antenna to antenna, at least in view of roughness, conductivity, slope, and antenna height-above-average-terrain (HAAT). Between these phenomena, a selected ellipticity may be a compromise.

In another embodiment, a plurality of coaxial parasitic elements, spaced outward beyond the single parasitic shown and with each sized according to rules comparable to those for known Yagi-type multi-element antennas, provide further improvement in overall gain, anisotropy, and sidelobe performance, at some cost in complexity, weight, size, wind loading, and like factors. Cost-benefit tradeoffs typically justify a first parasitic and may likewise justify additional parasitics in some embodiments. Beam width, referenced above, is determined in part by parasitic dimensions and positioning.

An elliptical parasitic 170, as shown in FIG. 5, has simple geometry, and thus simple analysis, has the least variation in curvature of any figure for a given difference in horizontal and vertical dimensions, and is readily fabricated. However, other shapes may exhibit superior signal characteristics. For example, an ellipse is a special case of an expression of the form $$\left|\frac{x}{a}\right|^m + \left|\frac{y}{b}\right|^n = 1 \tag{1}$$

for m=n=2, and is a circle if a=b. In the more general form shown in equation (1), the expression is termed a Lamé curve or superellipse. A parasitic in the shape of a superellipse having other positive values of m, n, such as m=n=2.5, may be preferred in some embodiments. In other embodiments, a parasitic in the form of a rectangle or rhombus, a combined figure having straight and curved parts, or a nonplanar figure may be preferred to a plane curved figure.

The material from which parasitic 170 is fabricated may be any conductor that enables realization of a desired extent of gain enhancement. Aluminum sheet of common alloys and treatments is highly conductive, light, and corrosion resistant, and may be readily machineable, stampable, or otherwise suited to fabrication using ordinary methods and tools. Other materials, such as soft copper, brasses, or the like may be preferred for parasitics 170 in some embodiments. Perforated materials, screening, conductive foil on circuit board stock, and the like may be preferable in some embodiments. Simple flat cutouts, rimmed construction, open-centered rings, and other forms may each be effective and preferred in some embodiments.

Planarity in the dipoles is not mandatory. Similarly, the parasitics 170 can be faceted, cylindrical, spherical or oblate (i.e., domed), or otherwise nonplanar in some embodiments. Positioning the parasitics off axis with reference to their respective radiators, or tilting them with respect to the beam axis, produces additional computational factors, but many such embodiments produce gain artifacts and other functional degradation that limits usability of most such variations. In terms of economics, basic configurations that are readily mass produced may be preferable in many embodiments.

In addition to the above variations, the parasitic does not need to have a continuous perimeter.

Figure 6:
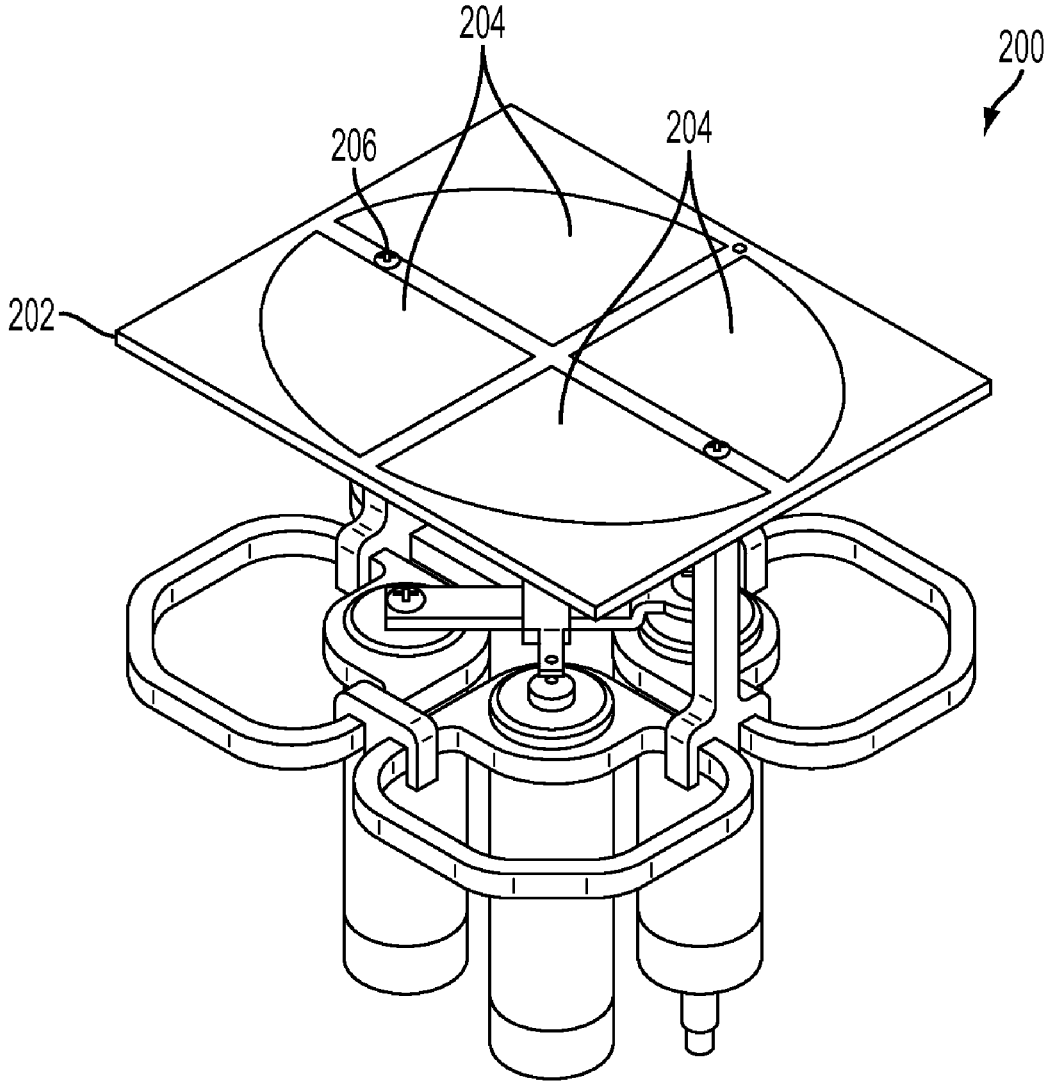
FIG. 6 is a perspective view of a radiator with an alternative parasitic element configuration, in accordance with an embodiment of the present invention.

FIG. 6 depicts a radiator 200 with a parasitic area that is divided into quadrant segments 204. The substrate 202 may be fabricated from circuit board material, for example, while the parasitic area formed from copper cladding, processed by methods such as, for example, etching, plating, applying corrosion resistant materials such as tin plating and epoxy coatings, etc., to provide reliability and durability for transceiver applications with power levels proportional to the signal strength capability of the conductive materials. The parasitic area in the embodiment shown may be supported by dielectric supporting material 206.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A phased-array antenna radiator for a cellular communication system, comprising:

a first dipole radiator including two coplanar monopole radiating elements disposed symmetrically about a radiation axis;

a second dipole radiator, arranged orthogonally with respect to the first dipole radiator, including two coplanar radiating elements disposed symmetrically about the radiation axis; and a parasitic gain element, having a substantially elliptical shape, disposed above the first and second dipole radiators and centered on the radiation axis, wherein the first and second dipole radiators each include a pair of monopole radiating elements supported by outer conductors, an inner conductor, a tuned stub and a feed strap.

2. The phased-array antenna radiator of claim 1, wherein the ellipticity of the parasitic gain element compensates for, and substantially equalizes, differential azimuth and elevation signal strength of the dipole radiators.

3. The phased-array antenna radiator of claim 1, wherein the parasitic gain element has a mean diameter of approximately a half-wavelength, and a height-to-width ratio within approximately 5% of circular.

4. The phased-array antenna radiator of claim 2, wherein the parasitic gain element increases main beam gain and decreases sidelobe gain based upon the mean diameter of the parasitic gain element and a spacing away from the dipole radiators.

5. The phased-array antenna radiator of claim 1, wherein the parasitic gain element is substantially planar.

6. The phased-array antenna radiator of claim 1, wherein the parasitic gain element has a substantially continuous surface.

7. The phased-array antenna radiator of claim 1, wherein the parasitic gain element has a faceted, cylindrical, or domed surface.

8. The phased-array antenna radiator of claim 1, wherein the parasitic gain element is a solid metal alloy.

9. The phased-array antenna radiator of claim 1, wherein the parasitic gain element has a nonmetallic substrate and a conductive outer layer.

10. The phased-array antenna radiator of claim 1, wherein the parasitic gain element has a plurality of conductive sectors electrically isolated by nonconductive portions and at least bilateral symmetry.

11. The phased-array antenna radiator of claim 10, wherein at least two of the conductive sectors are capacitively coupled.

12. The phased-array antenna radiator of claim 1, wherein the parasitic gain element has a raised rim.

13. The phased-array antenna radiator of claim 1, wherein parasitic gain element is a woven conductive material and has a perforated rim region.

14. The phased-array antenna radiator of claim 1, wherein the perimeter of the parasitic gain element is defined by a Lamé curve, expressed as:

$$\left|\frac{x}{a}\right|^m + \left|\frac{y}{b}\right|^n = 1$$

for m, n greater than 2 and a/b corresponding to the vertical to horizontal ratio termed ellipticity in an ellipse.

15. The phased-array antenna radiator of claim 1, wherein the perimeter of the parasitic gain element is defined by a rectangle, a rhombus, a continuously curved, multiply arcuate form, or a combination thereof, including curved and straight segments.

16. The phased-array antenna radiator of claim 1, wherein the inner conductor is disposed within a first corresponding outer conductor and extends therethrough, and has an upper termination protruding from the first outer conductor.

17. The phased-array antenna radiator of claim 16, wherein the tuned stub is disposed within a second outer conductor and extends partially therethrough, and has an upper termination protruding from the second outer conductor.

18. The phased-array antenna radiator of claim 17, wherein the feed strap is disposed above first and second outer conductors, and has one end attached to the upper termination of the inner conductor and another end attached to the upper termination of the tuned stub, and wherein the feed straps for the first and second dipole radiators cross.

19. A phased-array antenna radiator for a cellular communication system, comprising:

a first dipole radiator including two coplanar monopole radiating elements disposed symmetrically about a radiation axis;

a second dipole radiator, arranged orthogonally with respect to the first dipole radiator, including two coplanar radiating elements disposed symmetrically about the radiation axis; and a means for generating parasitic gain, disposed above the first and second dipole radiators and centered on the radiation axis, wherein the first and second dipole radiators each include a pair of monopole radiating elements supported by outer conductors, an inner conductor, a tuned stub and a feed strap.

* * * * *